US009482190B2

(12) United States Patent
Makino

(10) Patent No.: US 9,482,190 B2
(45) Date of Patent: Nov. 1, 2016

(54) EVAPORATED FUEL TREATING APPARATUS

(71) Applicant: AISAN KOGYO KABUSHIKI KAISHA, Obu-shi, Aichi-ken (JP)

(72) Inventor: Katsuhiko Makino, Obu (JP)

(73) Assignee: Aisan Kogyo Kabushiki Kaisha (JP)

( * ) Notice: Subject to any disclaimer, the term of this patent is extended or adjusted under 35 U.S.C. 154(b) by 19 days.

(21) Appl. No.: 13/867,252

(22) Filed: Apr. 22, 2013

(65) Prior Publication Data

US 2013/0284154 A1 Oct. 31, 2013

(30) Foreign Application Priority Data

Apr. 27, 2012 (JP) ..... 2012-103387

(51) Int. Cl.
*F02M 25/08* (2006.01)

(52) U.S. Cl.
CPC ..... *F02M 25/0854* (2013.01)

(58) Field of Classification Search
CPC ..... F02M 25/08; F02M 25/0854; B01D 2259/4516; B01D 2259/403; B01D 53/407; B01D 53/446; B60K 15/03504; B60K 2015/03514
See application file for complete search history.

(56) References Cited

U.S. PATENT DOCUMENTS 6,524,374 B2 2/2003 Moriyama et al.
6,540,815 B1 4/2003 Hiltzik et al.
RE38,844 E 10/2005 Hiltzik et al.
7,458,367 B2 12/2008 Kasuya
2002/0020398 A1* 2/2002 Kimoto et al. ..... 123/519
2002/0124732 A1* 9/2002 Hara et al. ..... 96/131
2004/0261777 A1* 12/2004 Ogawa ..... 123/698
2005/0061301 A1* 3/2005 Meiller et al. ..... 123/519
2005/0172938 A1* 8/2005 Uchino et al. ..... 123/519

(Continued)

FOREIGN PATENT DOCUMENTS

JP A-2001-323845 11/2001
JP 2002-030998 A 1/2002

(Continued)

OTHER PUBLICATIONS

Decision of Refusal, issued by the Japanese Patent Office on Feb. 3, 2016, in counterpart application No. JP-2012-103387.

(Continued)

*Primary Examiner* — Stephen K Cronin
*Assistant Examiner* — Anthony L Bacon
(74) *Attorney, Agent, or Firm* — Wood, Phillips, Katz, Clark & Mortimer

(57) ABSTRACT

An evaporated fuel treating apparatus, comprising a passage allowing circulation of fluid inside, a tank port and a purge port at one end of the passage, and an atmospheric port at the other end of the passage, and provided with a plurality of adsorption chambers each filled with granular activated carbon or crushed activated carbon in the passage, and a support member set between a first adsorption chamber located closest to the atmospheric port in the plurality of adsorption chambers and a second adsorption chamber located on the tank port side of the first adsorption chamber in the plurality of adsorption chambers, to space the first and second adsorption chambers apart from each other, and at least a part of the support member can adsorb evaporated fuel components. With this configuration, evaporated fuel components escaping to the outside through the atmospheric port are reduced.

11 Claims, 7 Drawing Sheets

(56) References Cited

U.S. PATENT DOCUMENTS

| | | | | |
|---|---|---|---|---|
| 2005/0223900 | A1* | 10/2005 | Yoshida et al. | 96/108 |
| 2007/0266997 | A1* | 11/2007 | Clontz et al. | 123/519 |
| 2009/0223370 | A1* | 9/2009 | Kosugi et al. | 96/126 |
| 2010/0095938 | A1* | 4/2010 | Kosugi et al. | 123/519 |
| 2011/0315126 | A1 | 12/2011 | Yoshida et al. | |

FOREIGN PATENT DOCUMENTS

| | | | |
|---|---|---|---|
| JP | 2002-266710 | A | 9/2002 |
| JP | 2003-003914 | A | 1/2003 |
| JP | A-2007-270726 | | 10/2007 |
| JP | A-2009-079595 | | 4/2009 |
| JP | A-2010-101196 | | 5/2010 |
| JP | 2012-007501 | A | 1/2012 |

OTHER PUBLICATIONS

Office Action issued Jun. 23, 2015 in Japanese Patent Appln. No. 2012-103387.

* cited by examiner

EVAPORATED FUEL TREATING APPARATUS

BACKGROUND OF THE INVENTION

1. Field of the Invention

The present invention relates to an evaporated fuel treating apparatus.

2. Description of Related Art

An evaporated fuel treating apparatus (hereinafter also referred to as a canister) which temporarily adsorbs fuel components in evaporated fuel has been used to prevent evaporated fuel from an automobile fuel tank or the like from being emitted into the atmosphere.

In recent years, canisters have been expected to reduce a dissipated amount of evaporated fuel into the atmosphere. As a canister which reduces a dissipated amount of evaporated fuel into the atmosphere, there is known a canister 101 disclosed in JPA-2001-323845 as shown in FIG. 10. The canister 101 includes a case 105 having a tank port 102, a purge port 103, and an atmospheric port 104. In the case 105, a main adsorption chamber 106, a second adsorption chamber 107, and a third adsorption chamber 108 are formed in order from the tank port 102 side. Activated carbon is provided in the main adsorption chamber 106, second adsorption chamber 107, and third adsorption chamber 108. A plate member 109 having a restriction portion for restricting diffusion of evaporated fuel is provided between the second adsorption chamber 107 and the third adsorption chamber 108.

The canister 101 has the plate member 109 having the restriction portion provided between the second adsorption chamber 107 and the third adsorption chamber 108 to thereby restrict diffusion of evaporated fuel from the second adsorption chamber 107 into the third adsorption chamber 108. This restricts escape of evaporated fuel components to the outside through the atmospheric port 104.

Although the plate member 109 in the conventional canister 101 has the restriction portion, a space formed by the plate member 109 provided between the second adsorption chamber 107 and the third adsorption chamber 108 has no adsorption capability and is less effective in delaying diffusion of evaporated fuel components from the second adsorption chamber 107 into the third adsorption chamber 108. It is thus desirable to reduce evaporated fuel components escaping to the outside through the atmospheric port 104 by delaying diffusion of evaporated fuel components into the third adsorption chamber 108 much longer and reducing evaporated fuel components left in the third adsorption chamber 108.

BRIEF SUMMARY OF THE INVENTION

Under the circumstances, the present invention has an object to provide an evaporated fuel treating apparatus which has reduced evaporated fuel components escaping to the outside through an atmospheric port, as compared to a conventional canister.

In order to solve the above-described problem, according to the present invention, an evaporated fuel treating apparatus is characterized in that a passage is formed to circulate fluid inside, a tank port and a purge port are formed at one end of the passage, and an atmospheric port is formed at another end of the passage; a plurality of adsorption chambers which are each filled with granular activated carbon or crushed activated carbon are provided in the passage; a support member is set between a first adsorption chamber, which is located closest to the atmospheric port, of the plurality of adsorption chambers and a second adsorption chamber, which is located on the tank port side of the first adsorption chamber, of the plurality of adsorption chambers so as to space the first and second adsorption chambers apart from each other; and, at least one part of the support member can adsorb an evaporated fuel component.

In the present invention, an amount of evaporated fuel component adsorbed per unit space volume of a part having adsorption capability of the support member may be smaller than an amount of evaporated fuel component adsorbed per unit space volume of granular activated carbon or crushed activated carbon, with which the first adsorption chamber is filled, or an amount of evaporated fuel component left after purging per unit space volume may be small.

In the present invention, the at least one part of the support member may be formed by molding a kneaded mixture of adsorbent which can adsorb an evaporated fuel component and a binder.

In the present invention, the at least one part of the support member may be formed by additionally attaching adsorbent which can adsorb an evaporated fuel component to a metal material or a resin material.

In the present invention, the at least one part of the support member may be composed of activated carbon member in a form of a honeycomb or a monolith.

In the present invention, the support member may include a restriction portion which restricts diffusion of evaporated fuel to a flow along the passage.

In the present invention, heat may be applied to at least between the first adsorption chamber and the second adsorption chamber during purging.

According to the present invention, the first adsorption chamber and second adsorption chamber filled with granular activated carbon or crushed activated carbon are spaced apart from each other, and the support member, at least one part of which can adsorb an evaporated fuel component, is provided between the first adsorption chamber and the second adsorption chamber. With this configuration, evaporated fuel is adsorbed between the first adsorption chamber and the second adsorption chamber. This allows diffusion of evaporated fuel from the second adsorption chamber into the first adsorption chamber to be delayed and can reduce the amount of evaporated fuel escaping into the atmosphere smaller than that in a conventional canister.

DETAILED DESCRIPTION OF THE INVENTION

Embodiments according to the present invention will be described with reference to the drawings.

[Embodiment 1]

FIGS. 1 to 4 show Embodiment 1 according to the present invention.

Figure 2:
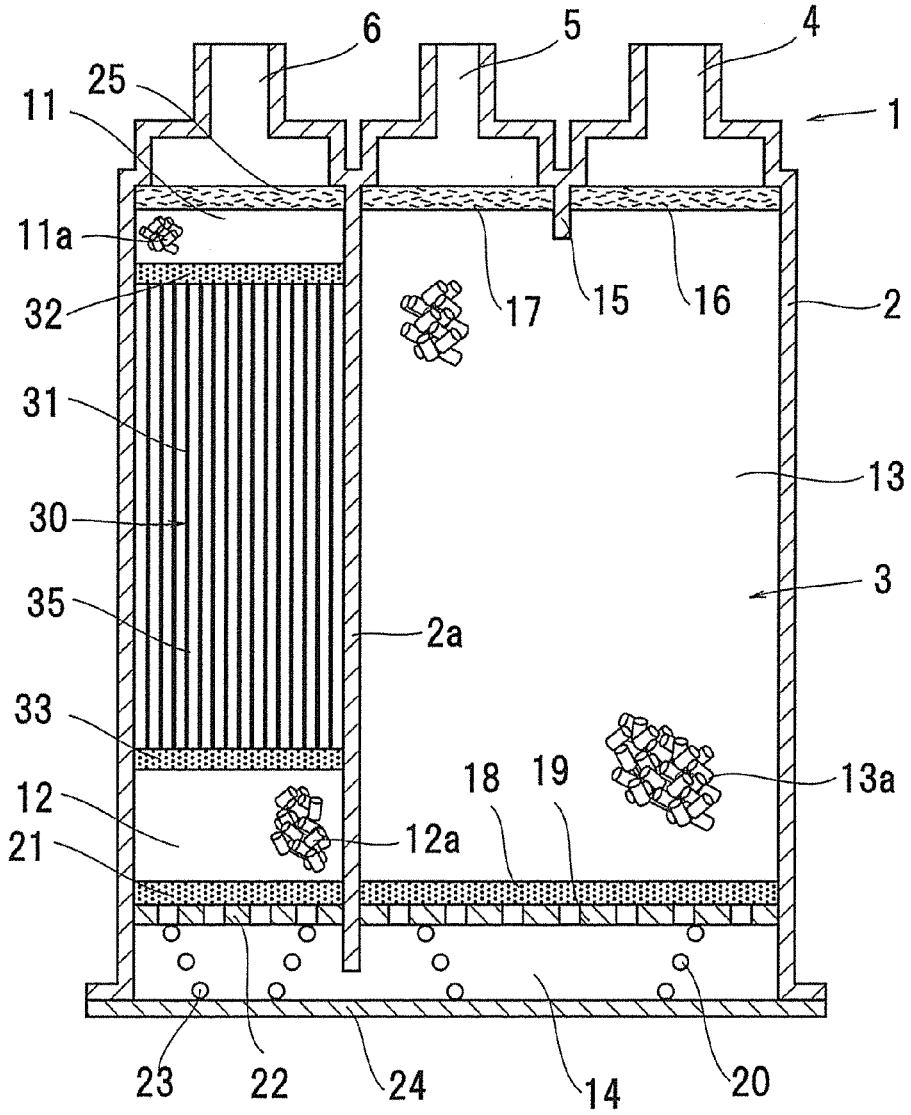
FIG. 2 is a schematic cross-sectional view of the evaporated fuel treating apparatus according to Embodiment 1 of the present invention.

As shown in FIG. 2, an evaporated fuel treating apparatus 1 according to the present invention includes a case 2, and a passage 3 through which fluid can circulate is formed inside the case 2. The passage 3 in the case 2 has a tank port 4 and a purge port 5 formed at one end and an atmospheric port 6 formed at the other end, as shown in FIG. 2.

In the passage 3, a plurality of adsorption chambers filled with granular activated carbon or crushed activated carbon that is activated carbon are provided as a first adsorption chamber 11, a second adsorption chamber 12, and a third adsorption chamber 13 in order from the atmospheric port 6 side. In the case 2, a partition wall 2*a* is provided to separate the third adsorption chamber 13 communicating with the tank port 4 and purge port 5 and the first adsorption chamber 11 and second adsorption chamber 12 from each other, as shown in FIG. 2.

The third adsorption chamber 13 and second adsorption chamber 12 communicate with each other via a space 14 which is formed on a side opposite to the atmospheric port 6 in the case 2. When gas is to flow from the tank port 4 to the atmospheric port 6, gas flows in a substantially U-shaped manner while turning back at the space 14.

Figure 1:
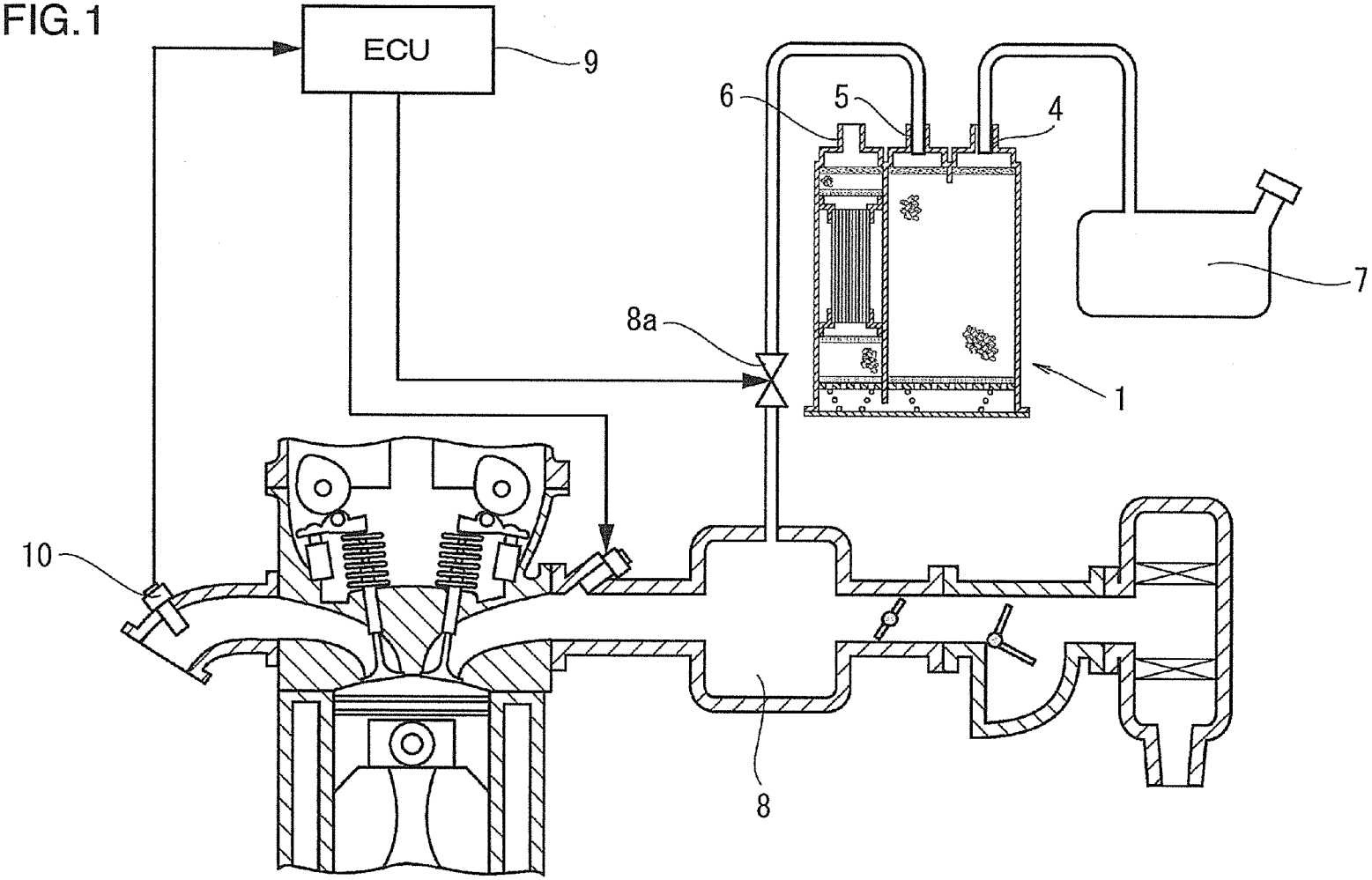
FIG. 1 is a schematic view for explaining an evaporated fuel treating apparatus according to Embodiment 1 of the present invention.

As shown in FIG. 1, the tank port 4 communicates with an upper air chamber of a fuel tank 7, and the purge port 5 is connected to an intake passage 8 of an engine via a purge control valve (VSV) 8*a*. The open angle of the purge control valve 8*a* is controlled by an electronic control unit (ECU) 9, and purge control is performed on the basis of a measured value, etc. from an A/F sensor 10 or the like during engine operation. The atmospheric port 6 communicates with the outside via a passage (not shown).

A baffle plate 15 which extends from an inner side surface of the case 2 to reach a part of the third adsorption chamber 13 is provided between the tank port 4 and the purge port 5 in the case 2. With the baffle plate 15, fluid to flow between the tank port 4 and the purge port 5 circulates through the third adsorption chamber 13.

The first adsorption chamber 11, second adsorption chamber 12, and third adsorption chamber 13 are filled with activated carbon 11 a, activated carbon 12*a* and activated carbon 13*a*, respectively, which are granular activated carbon or crushed activated carbon, so as to form an adsorbent layer, respectively. As the activated carbon 11*a*, activated carbon 12*a* and activated carbon 13*a*, with which the adsorption chambers 11, 12, and 13 are filled, activated carbon of the same type, different types of activated carbon, or mixtures of a plurality of types of activated carbon may be used.

The third adsorption chamber 13 is covered with a filter 16 which is made of non-woven fabric or the like on the tank port 4 side and is covered with a filter 17 which is made of non-woven fabric or the like on the purge port 5 side. On a lower surface of the third adsorption chamber 13 is provided a filter 18 which covers the entire lower surface and is made of urethane or the like, and a plate 19 having many communication holes is provided underneath the filter 18. The plate 19 is biased toward the tank port 4 side by biasing means 20 such as a spring.

On the space 14 side of the second adsorption chamber 12 is provided a filter 21 which covers the entire thereof and is made of urethane or the like. A plate 22 having many communication holes substantially evenly formed across the plate 22 is provided on the space 14 side of the filter 21. The plate 22 is biased toward the atmospheric port 6 by biasing member 23 such as a spring.

The space 14 described above is formed between the plates 19 and 22 and a cover plate 24 of the case 2. With the space 14, the second adsorption chamber 12 and third adsorption chamber 13 communicate with each other.

On the atmospheric port 6 side of the first adsorption chamber 11 is provided a filter 25 which covers the entire thereof and is made of non-woven fabric or the like.

As shown in FIG. 2, a delay diffusion chamber 30 which delays diffusion of evaporated fuel from the second adsorption chamber 12 into the first adsorption chamber 11 is provided between the first adsorption chamber 11 and the second adsorption chamber 12. In the delay diffusion chamber 30, a support member 31 is provided over almost a whole of the delay diffusion chamber 30 in a flow direction in the passage 3, a filter 32 which is made of urethane or the like is provided between the support member 31 and the first adsorption chamber 11 over an entire cross-section of the passage 3, and a filter 33 which is made of urethane or the like is provided between the support member 31 and the second adsorption chamber 12 over the entire cross-section of the passage 3.

At least a part of the support member 31 has the adsorption capability of adsorbing and desorbing evaporated fuel components. The amount of evaporated fuel component adsorbed per unit space volume of the part having adsorption capability is set to be smaller than the amount of evaporated fuel component adsorbed per unit space volume of the granular activated carbon or crushed activated carbon 11*a*, with which the first adsorption chamber 11 is filled, or the amount of evaporated fuel component left after purging per unit space volume of the part having adsorption capability is set to be smaller than the amount of evaporated fuel component left after purging per unit space volume of the granular activated carbon or crushed activated carbon 11*a*, with which the first adsorption chamber 11 is filled.

The support member 31 has strength high enough to prevent itself from being deformed by biasing force of the biasing member 23. The support member 31 is so provided to space the first adsorption chamber 11 and second adsorption chamber 12 apart from each other.

The support member 31 includes, as a main portion, a member formed by additionally attaching adsorbent (e.g., activated carbon) having the adsorption capability of adsorbing and desorbing evaporated fuel components to a part of a plate-like member provided in the flow direction (axial direction) of the passage 3, made of metal, resin, or the like, and having strength not less than a predetermined strength or a columnar member having a hollow portion open at two ends in the axial direction, or a member (e.g., activated carbon formed in a form of a honeycomb or monolith)

formed by molding a kneaded mixture of an adsorbent such as activated carbon which has the adsorption capability of adsorbing and desorbing evaporated fuel components and a binder such as resin which can bind the adsorbent together.

Figure 3:
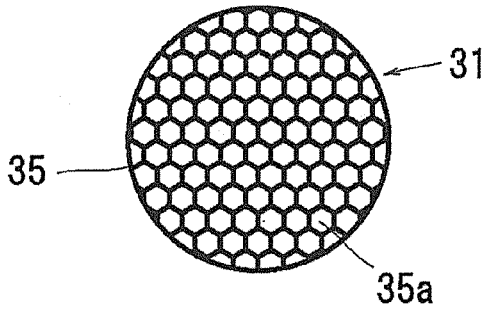
FIG. 3 is a cross-sectional view of an example of a support member used in Embodiment 1 of the present invention.
Figure 4:
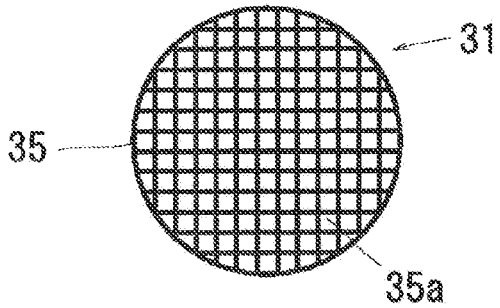
FIG. 4 is a cross-sectional view of another example of the support member used in Embodiment 1 of the present invention.

The support member 31 according to the present embodiment is composed only of activated carbon member 35 in the form of a honeycomb as shown in FIG. 3 or in the form of a monolith as shown in FIG. 4 (hereinafter also simply referred to activated carbon member). The activated carbon member in the form of a honeycomb or monolith is smaller in the amount of evaporated fuel component adsorbed per unit space volume and in the amount of evaporated fuel component left after purging per unit space volume than granular activated carbon or crushed activated carbon. As shown in FIG. 2, the activated carbon member 35 is provided over an entire cross-section of the passage 3, and the filters 32 and 33 are disposed at two ends of the activated carbon member 35. The total opening area of hollow portions 35*a* which are provided in the activated carbon member 35 is set to be larger than the opening areas of the tank port 4 and purge port 5.

With the above-described configuration, gas including evaporated fuel and flowing into the evaporated fuel treating apparatus 1 through the tank port 4 flows into the third adsorption chamber 13, space 14, and second adsorption chamber 12. After the fuel component is adsorbed by the activated carbon 13*a* and activated carbon 12*a* in the third adsorption chamber 13 and second adsorption chamber 12, the gas flows into the hollow portions 35*a* of the activated carbon member 35 provided in the delay diffusion chamber 30. After the evaporated fuel is adsorbed by the activated carbon member 35, the gas passes through the first adsorption chamber 11 while the fuel component is adsorbed by the activated carbon 11 a therein. The gas is discharged to the atmosphere through the atmospheric port 6.

At the time of purge control during engine operation, the purge control valve 8*a* is opened by the electronic control unit (ECU) 9, air sucked into the evaporated fuel treating apparatus 1 through the atmospheric port 6 according to a negative pressure in the engine intake passage 8 flows in a direction opposite to the above-described direction and is supplied from the purge port 5 to the engine intake passage 8. At this time, each fuel component adsorbed by the activated carbon 11*a*, activated carbon 12*a*, activated carbon 13*a*, and activated carbon member 35 is desorbed and are supplied to the engine together with air.

The evaporated fuel treating apparatus 1 according to the present invention with the above-described structure and configuration can achieve the operations and effects as follows.

The delay diffusion chamber 30 including the activated carbon member 35 in the form of a honeycomb or monolith that is smaller in the amount of fuel component adsorbed per unit space volume than granular activated carbon or crushed activated carbon is provided between the first adsorption chamber 11, that is located closest to the atmospheric port 6, of the adsorption chambers filled with granular activated carbon or crushed activated carbon that adsorbs a large amount of fuel component per unit space volume and the second adsorption chamber 12, that is located on the tank port 4 side of the first adsorption chamber 11, of the adsorption chambers filled with granular activated carbon or crushed activated carbon. This configuration allows diffusion of evaporated fuel from the second adsorption chamber 12 into the first adsorption chamber 11 to be delayed.

Additionally, the activated carbon member 35 in the delay diffusion chamber 30 can adsorb the fuel component in the delay diffusion chamber 30, which reduces the concentration gradient of evaporated fuel in the delay diffusion chamber 30 in the circulation direction of the passage 3 and allows diffusion of evaporated fuel from the second adsorption chamber 12 into the first adsorption chamber 11 to be delayed much longer than in a conventional canister.

Thus, diffusion of fuel components into the first adsorption chamber 11 can be reduced, and the amount of evaporated fuel escaping into the atmosphere can be reduced, as compared to the prior art.

[Embodiment 2]

Figure 5:
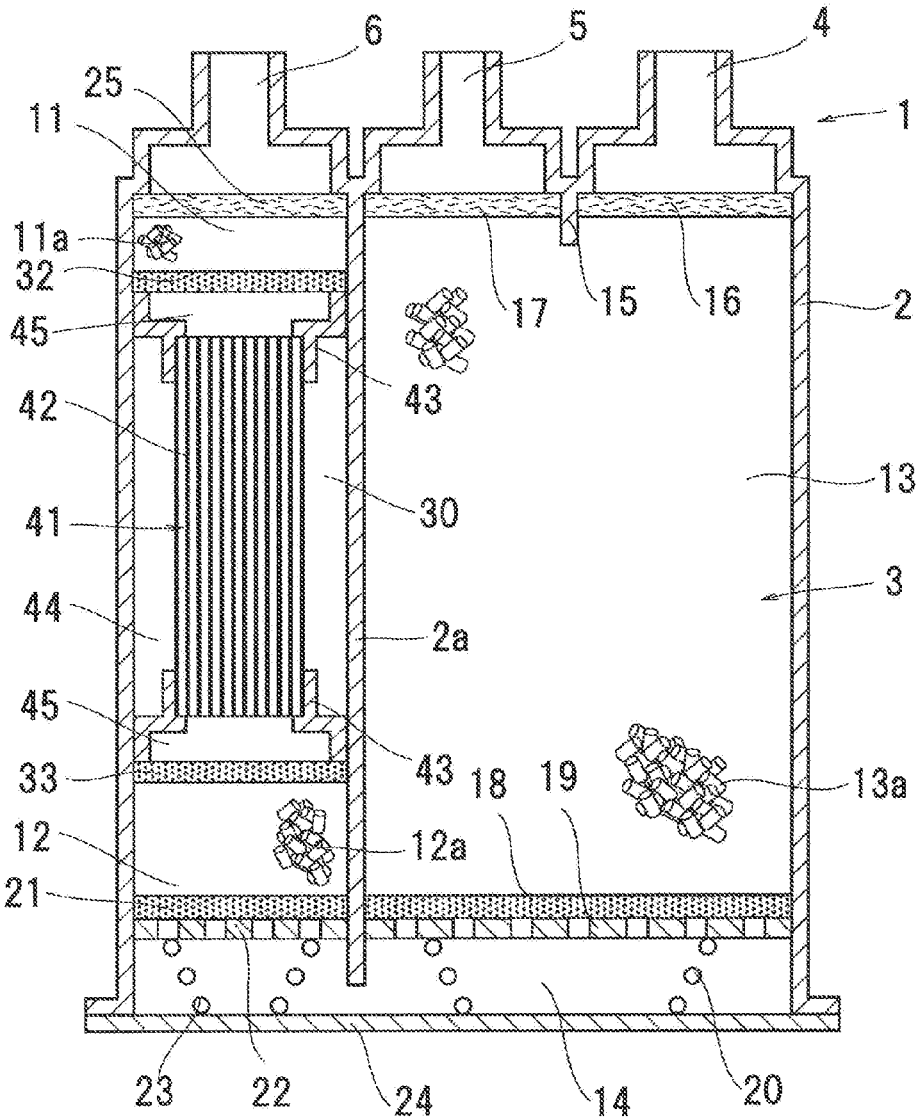
FIG. 5 is a schematic cross-sectional view of an evaporated fuel treating apparatus according to Embodiment 2 of the present invention.

FIG. 5 shows Embodiment 2 according to the present invention.

Embodiment 2 of the present invention has the same structure as that of Embodiment 1 except that a support member 41 in a delay diffusion chamber 30 is different from the support member 31 according to Embodiment 1.

As shown in FIG. 5, the support member 41 is composed of activated carbon member 42 in a form of a honeycomb or monolith (hereinafter also referred to as activated carbon member) and restriction portions 43, 43 which are provided at two ends of the activated carbon member 42.

The activated carbon member 42 is set such that its outer diameter is smaller than the inner diameter of the delay diffusion chamber 30, and a space 44 is formed between an outer peripheral surface of the activated carbon member 42 and an inner peripheral surface of the delay diffusion chamber 30.

As shown in FIG. 5, the restriction portions 43, 43 are each formed such that its one end fits on the outer peripheral surface of the activated carbon member 42 and the opening area at the one end of each restriction portion 43 is smaller than the opening area at the other end. With the restriction portions 43, spaces 45, 45 are each formed between the one end of the activated carbon member 42 and the filter 32 and between the other end and the filter 33, respectively. Note that a sealant may be provided between the one end of each restriction portion 43 and the activated carbon member 42.

As seen in FIG. 5, the first and second adsorption chambers 11, 12 are spaced from each other in the flow direction. The support member 41, the spaced restriction portions/members 43, and the spaced filters 32, 33 reside between the spaced first and second adsorption chambers 11, 12.

Note that the restriction portion 43 may be formed in any shape as long as an opening on the first adsorption chamber 11 side or on the second adsorption chamber 12 side is larger than an opening on the activated carbon member 42 side. For example, as shown in FIG. 5, the one end of each restriction portion 43 may be made smaller in diameter than the other end as well as one open hole may be formed at both ends thereof. Alternatively, each restriction portion 43 may be formed such that the diameter is even along an axial direction and the other end is partially blocked.

The remaining parts of the structure are the same as those in Embodiment 1, and thus, a description thereof will be omitted. The same members as those in Embodiment 1 are denoted by the same reference numerals.

Embodiment 2 achieves the same effects as those of Embodiment 1.

Additionally, in Embodiment 2, the evaporated fuel flowing in from the first adsorption chamber 11 or the second adsorption chamber 12 diffuses in the space 45 between the filter 32 or 33 and the restriction portion 43. Therefore, as compared with Embodiment 1, the evaporated fuel flows into hollow portions 42*a* in the activated carbon member 42 over substantially the whole of the activated carbon member 42, and thus, diffusion of the evaporated fuel from the second adsorption chamber 12 into the first adsorption chamber 11 can be delayed longer, and the amount of evaporated fuel escaping into the atmosphere can be made smaller than that of Embodiment 1.

Moreover, since the restriction portions 43 are provided between the second adsorption chamber 12 and the first adsorption chamber 11, this configuration can diffuse the evaporated fuel from the second adsorption chamber 12 into the first adsorption chamber 11 to be delayed, thereby, reducing the amount of evaporated fuel escaping into the atmosphere.

[Embodiment 3]

Figure 6:
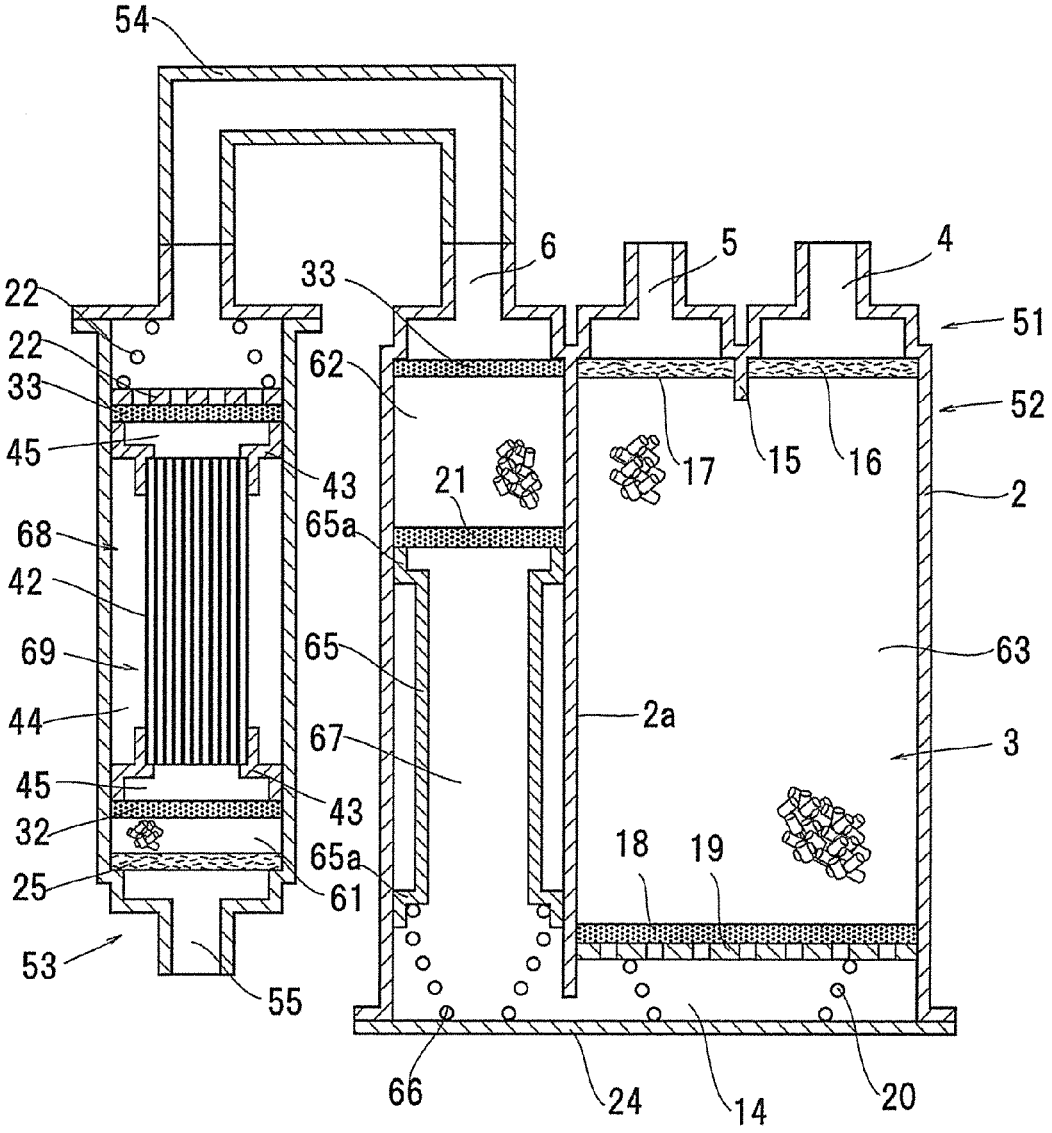
FIG. 6 is a schematic cross-sectional view of an evaporated fuel treating apparatus according to Embodiment 3 of the present invention.

FIG. 6 shows Embodiment 3 according to the present invention.

An evaporated fuel treating apparatus 51 according to Embodiment 3 includes a main canister 52 and a sub-canister 53. The main canister 52 and the sub-canister 53 communicate with each other via a communicating tube 54.

In the sub-canister 53, a first adsorption chamber 61 which is filled with granular activated carbon or crushed activated carbon is formed on the atmospheric port 55 side. In the main canister 52, a second adsorption chamber 62 and a third adsorption chamber 63 which are filled with granular activated carbon or crushed activated carbon are formed. The third adsorption chamber 63 has the similar configuration to that of the third adsorption chamber 13 according to Embodiments 1, 2. A space forming member 65 is provided on a space 14 side of the second adsorption chamber 62. The space forming member 65 is biased toward the communicating tube 54 by biasing means 66 such as a spring and forms a space 67. Restriction portions 65*a*, 65*a* which reduce a flow cross-sectional area in a passage 3 are formed at two ends of the space forming member 65.

A delay diffusion chamber 68 which is the same as the delay diffusion chamber 30 of Embodiments 1, 2 is provided on the communicating tube 54 side of the first adsorption chamber 61 in the sub-canister 53. In the delay diffusion chamber 68, a support member which is the same as the support members 31 and 41 of Embodiments 1, 2 is provided. FIG. 6 shows an example to which a support member 69 having the same structure as that of the support member 41 of Embodiment 2 is applied.

The remaining parts of the structure are the same as those in Embodiments 1, 2, and a description thereof will be omitted. The same members as those in Embodiments 1, 2 are denoted by the same reference numerals.

Embodiment 3 achieves the same effects as those of Embodiments 1, 2.

[Embodiment 4]

Figure 7:
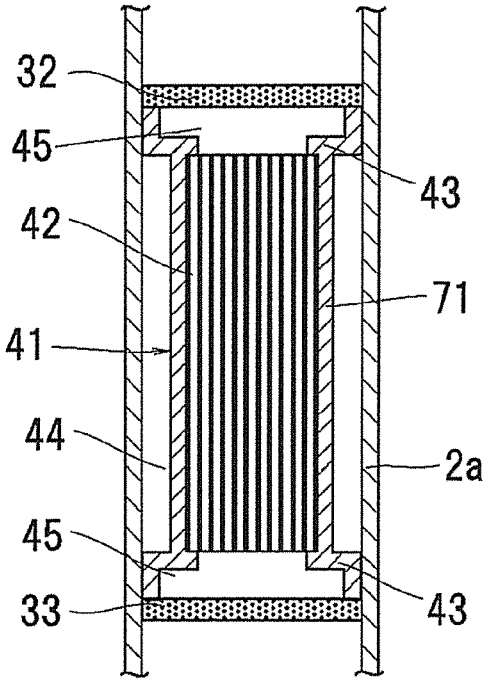
FIG. 7 is a schematic partial enlarged sectional view of an evaporated fuel treating apparatus according to Embodiment 4 of the present invention.

FIG. 7 shows Embodiment 4 according to the present invention.

In Embodiments 2, 3, one ends of the restriction portions 43, 43 are fit on two ends of the support member 41. However, a tubular member 71 which can accommodate a support member 41 may be provided between restriction members 43, 43, so as to form the tubular member 71 integrally with the restriction members 43, as shown in FIG. 7.

The remaining parts of the structure are the same as those in Embodiments 2, 3, and a description thereof will be omitted.

Embodiment 4 achieves the same effects as those of Embodiments 2, 3.

[Embodiment 5]

Figure 8:
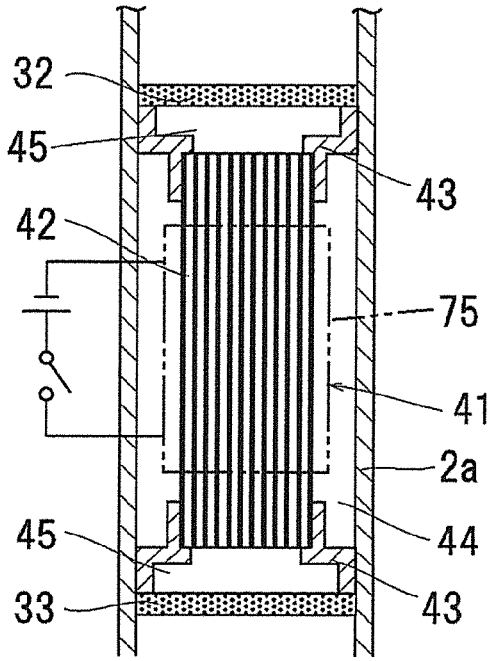
FIG. 8 is a schematic partial enlarged sectional view of an evaporated fuel treating apparatus according to Embodiment 5 of the present invention.
Figure 9:
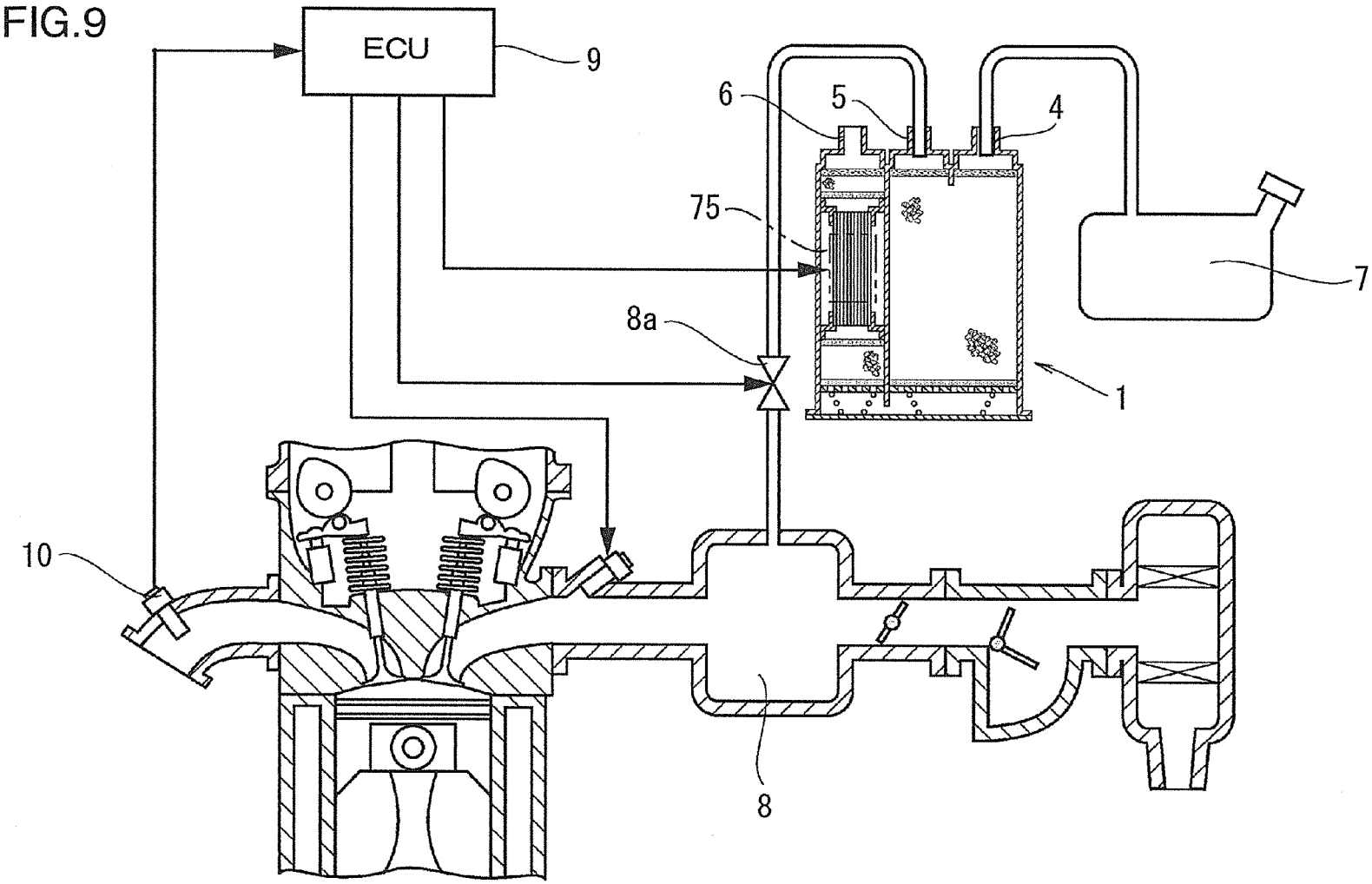
FIG. 9 is a schematic view for explaining the evaporated fuel treating apparatus according to Embodiment 5 of the present invention.
Figure 10:
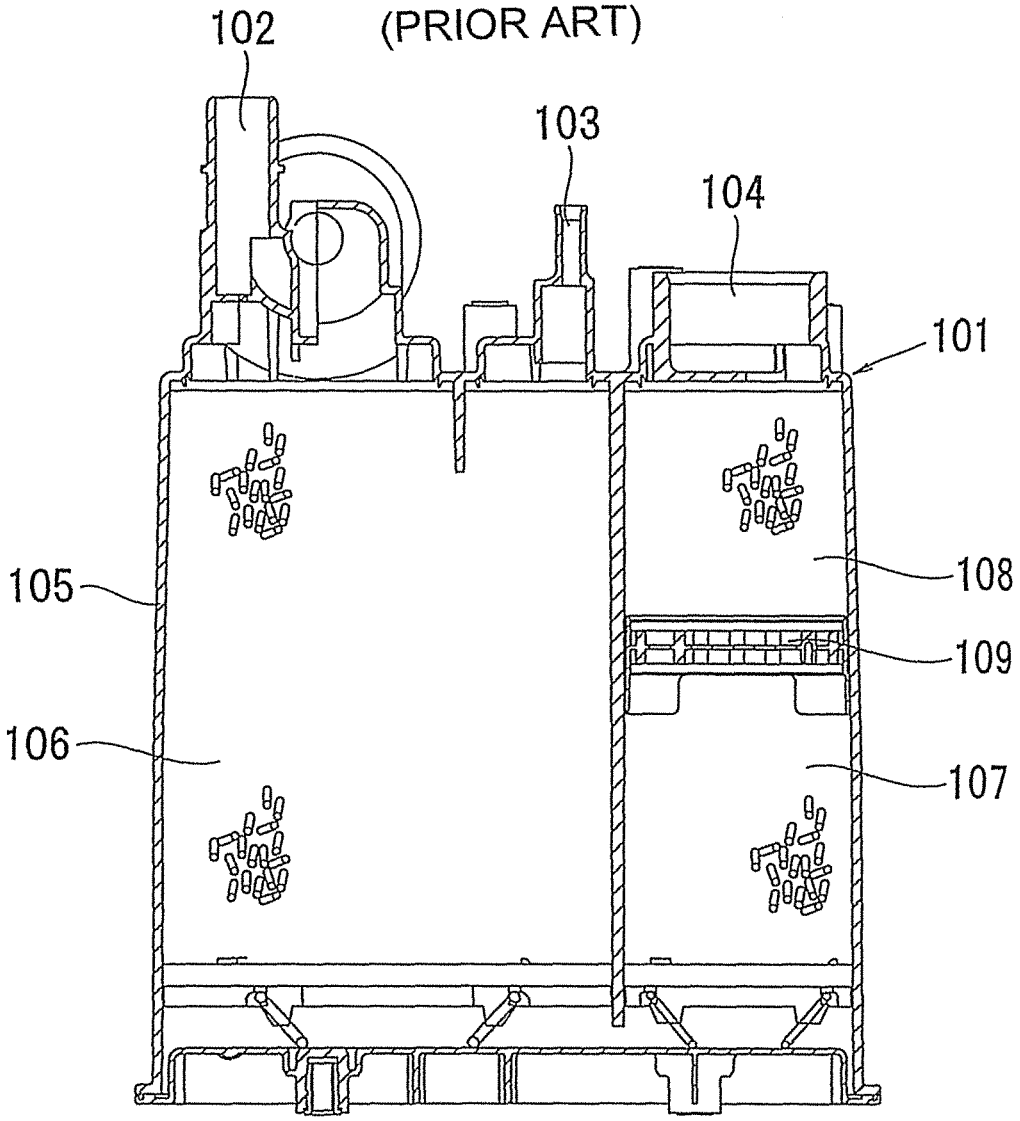
FIG.10 (PRIOR ART)
FIG. 10 is a schematic configuration cross-sectional view showing a conventional evaporated fuel treating apparatus.

FIGS. 8 and 9 show Embodiment 5 according to the present invention.

Embodiment 5 is configured such that at least the support members 31, 41 and 69 are heated by heating means 75 during purging of the evaporated fuel treating apparatus 1 and 51 according to Embodiments 2 to 4. The heating means 75 is controlled by an electronic control unit (ECU) 9.

In the present embodiment, the heating means 75 is wound around an outer peripheral surface of the support members 31, 41 and 69. However, arbitrary heating means may be adopted as long as the heating means can heat at least the support members 31, 41 and 69 during purging.

Note that, during purging, the adsorption chambers 11, 12 and 13 may be heated together with the support member 31, 41 and 69, or, the entire evaporated fuel treating apparatus 1 and 51 may be heated.

The remaining parts of the structure are the same as those in Embodiments 1 to 4, and a description thereof will be omitted.

Embodiment 5 achieves the same effects as those of Embodiments 1 to 4.

Additionally, in Embodiment 5, since the support members 31, 41 and 69 are heated during purging, as compared with Embodiments 1 to 4, the amount of fuel component left in the activated carbon members 35, 42 in a delay diffusion chambers 30, 68 can be made smaller, and diffusion of evaporated fuel from the second adsorption chamber 12 into the first adsorption chamber 11 can be delayed much longer, so as to reduce the amount of evaporated fuel escaping into the atmosphere.

[Other Embodiments]

A shape of the evaporated fuel treating apparatus, the number and shapes of the adsorption chambers containing activated carbon, and the number and shapes of the space chambers not filled with activated carbon can be arbitrarily set, and the order in which the adsorption chambers and space chambers are arranged can be arbitrarily set, as long as a plurality of adsorption chambers filled with granular activated carbon or crushed activated carbon are provided, and a delay diffusion chamber having a support member is provided between a first adsorption chamber, which is located closest to an atmospheric port, of the plurality of adsorption chambers and a second adsorption chamber, which is located on a tank port side of the first adsorption chamber, of the plurality of adsorption chambers. The type of activated carbon to be contained in each adsorption chamber can also be arbitrarily set.

The invention claimed is:

1. An evaporated fuel treating apparatus wherein:

a passage is formed to circulate fluid inside, a tank port and a purge port are formed at one end of said passage, and an atmospheric port is formed at another end of said passage;

a plurality of adsorption chambers which are each filled with one of granular activated carbon and crushed activated carbon are provided in said passage;

a delay diffusion chamber is provided between: a) a first adsorption chamber, in said plurality of adsorption chambers, which is located closest to the atmospheric port; and b) a second adsorption chamber, in said plurality of adsorption chambers, which is located on a tank port side of said first adsorption chamber, said delay diffusion chamber configured to delay diffusion of evaporated fuel components from the second adsorption chamber into the first adsorption chamber;

a support member is provided over substantially a whole of the delay diffusion chamber in the flow direction and is configured to space said first and second adsorption chambers apart from each other;

at least one part of said support member has spaced ends and is configured to adsorb an evaporated fuel component;

said support member has hollow portions in said delay diffusion chamber, as viewed in cross-section in a direction orthogonal to the flow direction, with a combined area larger than an opening area of each of the tank port and the purge port;

said support member includes a restriction portion which is configured to restrict diffusion of the evaporated fuel to a flow along the passage;

said restriction portion includes a pair of restriction members which are provided at two ends of said support member, each said restriction member having openings spaced in the flow direction and, for each said restriction member, one of the openings spaced in the flow direction is on a side of the support member and the other of the openings spaced in the flow direction is on a side of one of the first and second adsorption chambers;

one of said pair of restriction members is formed such that the opening in the one of the restriction members on the side of said first adsorption chamber or said second adsorption chamber is larger than the opening in the one of the restriction members on the side of said support member;

a first filter is provided between the restriction member that is on the side of said first adsorption chamber and said first adsorption chamber over the entire cross-section of the passage as viewed in a direction orthogonal to the flow direction; and a second filter is provided between the restriction member that is on the side of said second adsorption chamber and said second adsorption chamber over the entire cross-section of the passage as viewed in a direction orthogonal to the flow direction, the support member, the restriction members and the filters residing between the first and second adsorption chambers, wherein a first space is formed between one of the spaced ends of the at least one part of said support member and the first filter and a second space is formed between the other of the spaced ends of the at least one part of said support member and the second filter.

2. The evaporated fuel treating apparatus according to claim 1, wherein an amount of evaporated fuel component adsorbed per unit space volume of a part having adsorption capability of said support member is smaller than an amount of evaporated fuel component adsorbed per unit space volume of the one of granular activated carbon and crushed activated carbon, with which said first adsorption chamber is filled, or an amount of evaporated fuel component left after purging per unit space volume is small.

3. The evaporated fuel treating apparatus according to claim 1, wherein said at least one part of said support member is formed by molding a kneaded mixture of adsorbent which can adsorb an evaporated fuel component and a binder.

4. The evaporated fuel treating apparatus according to claim 1, wherein said at least one part of said support member is formed by additionally attaching adsorbent which can adsorb an evaporated fuel component to one of a metal material and a resin material.

5. The evaporated fuel treating apparatus according to claim 1, wherein said at least one part of said support member is composed of activated carbon member in a form of a honeycomb or a monolith.

6. The evaporated fuel treating apparatus according to claim 1, wherein a tubular member which can accommodate therein said support member is provided between said pair of restriction members so as to form said tubular member integrally with said pair of restriction members.

7. The evaporated fuel treating apparatus according to claim 1, wherein heat is applied to at least between said first adsorption chamber and said second adsorption chamber during purging.

8. The evaporated fuel treating apparatus according to claim 1 wherein the one of said pair of restriction members has its other opening on the side of the second adsorption chamber.

9. The evaporated fuel treating apparatus according to claim 1 wherein the one of said pair of restriction members has its other opening on the side of the first adsorption chamber.

10. The evaporated fuel treating apparatus according to claim 8 wherein the other of said pair of restriction members has its other opening on the side of the first adsorption chamber and each of the restriction members is formed such that its respective opening on the side of the support member is smaller than its respective opening on the side of the first or second adsorption chambers.

11. The evaporated fuel treating apparatus according to claim 1 wherein the hollow portions define a honeycomb shape as viewed in cross-section in a direction orthogonal to the flow direction.

* * * * *